US011149540B2

(12) United States Patent
Elbadawy et al.

(10) Patent No.: US 11,149,540 B2
(45) Date of Patent: Oct. 19, 2021

(54) METHODS AND SYSTEMS FOR EMBEDDING TRACERS WITHIN A DOWNHOLE TOOL

(71) Applicant: Vertice Oil Tools, Missouri City, TX (US)

(72) Inventors: Hossam Elbadawy, Houston, TX (US); Richard Gaut, Houston, TX (US)

(73) Assignee: Vertice Oil Tools, Missouri City, TX (US)

( * ) Notice: Subject to any disclaimer, the term of this patent is extended or adjusted under 35 U.S.C. 154(b) by 0 days.

(21) Appl. No.: 16/569,604

(22) Filed: Sep. 12, 2019

(65) Prior Publication Data

US 2020/0109621 A1 Apr. 9, 2020

Related U.S. Application Data

(60) Provisional application No. 62/740,789, filed on Oct. 3, 2018.

(51) Int. Cl.
*E21B 47/11* (2012.01)

(52) U.S. Cl.
CPC ..... *E21B 47/11* (2020.05); *B01F 2215/0081* (2013.01)

(58) Field of Classification Search
CPC ..... E21B 47/11; E21B 43/26; E21B 2200/06; E21B 49/00; E21B 43/10
See application file for complete search history.

(56) References Cited

U.S. PATENT DOCUMENTS

2011/0277996 A1* 11/2011 Cullick ..... E21B 33/138 166/250.12
2017/0167226 A1* 6/2017 Barbato ..... E21B 34/12
2018/0087369 A1* 3/2018 Sherman ..... E21B 47/00

FOREIGN PATENT DOCUMENTS

WO WO-2014104914 A1 * 7/2014 ..... E21B 47/11

* cited by examiner

*Primary Examiner* — Zakiya W Bates
(74) *Attorney, Agent, or Firm* — Pierson IP, PLLC

(57) ABSTRACT

Embedding tracer material within a frac tool. More specifically, directly mixing a tracer material with dissolvable materials that are then positioning with a frac tool, positioning tracer material within a dissolvable chamber within the frac tool, coating down hole tools with tracer material, forming portions of down hole tools with tracer materials.

10 Claims, 3 Drawing Sheets

METHODS AND SYSTEMS FOR EMBEDDING TRACERS WITHIN A DOWNHOLE TOOL

BACKGROUND INFORMATION

Field of the Disclosure

Examples of the present disclosure relate to embedding tracer material within a frac tool. More specifically, embodiments are directed towards directly mixing a tracer material with dissolvable materials, positioning the mixture within a dissolvable chamber within the frac tool, coating frac tool with tracer material, and forming portions of frac tool with the tracer materials.

Background

Reservoir and formation monitoring require dependable downhole data-acquisition systems. Monitoring is essential part of good reservoir management, which allow producers to better manage natural resources and efficiently produce from the wells Various monitoring methods exist, this include down hole gauges, fiber optics and other sonic and acoustic methods. These methods provide a good monitoring capability, however, they lack in reliability and can be extremely cost prohibitive for most wells Another alternative is tracer materials which is usually more cost-effective alternative, it can be utilized to determine producing zones, stages or clusters, an injection profile, location of fractures created by hydraulic fracturing, or otherwise collect down well information. Another application is when combining the tracer material within the product or mixed with the base material, the tracer material can provide a positive indication that certain equipment has functioned, that function could be mechanical movement or successful dissolving. Different types of tracers may be utilized in the same well to determine or isolate various stages of a well. The different tracers may have different half-lives for each stage, colorings, or any other unique identifiers that can be utilized to determine down well information. Conventionally, tracers are injected along into the wellbore or mechanically attached to the tools. Upon returning to the surface allowing with the fracturing fluid, the tracers are analyzed to determine downhole data.

However, situations may arise where tracers get mixed together, do not return in a symmetrical manner, or it is desirable to return tracers without intervention. Also, in many situations, having to attach the tracer mechanically to the down hole tools may create geometrical challenge. This may cause restrictions in the tool internal diameter, increase in tool external diameter, and increase the cost of the down hole tool substantially. These changes cause the downhole too to be cost prohibitive Accordingly, needs exist for system and methods for having tracer material that is mixed within the downhole tools before the mixture is positioned down well, wherein the tracer material may be embedded within a dissolvable material or other kind of materials.

SUMMARY

Embodiments disclosed herein describe embedding tracer materials within downhole tools before the downhole tools are positioned down well. In embodiments, tracer material may be embedded within the dissolvable material by mixing tracer materials in its powder or ash form directly with the dissolvable or other materials. As such, the tracer materials act as a concentration that is dissolved into the dissolvable material that acts as a solvent.

In other embodiments, a tracer material or mixture with tracer material may be positioned within a chamber, wherein sidewalls of the chamber may be dissolvable. The chamber may be configured to house a solid tracer, liquid tracer, power or ash tracer, etc. Responsive to the at least one sidewall of the dissolvable chamber dissolving, the tracer positioned within the chamber may be exposed, allowing the tracer to return to a surface of the wellbore. Further, the tracer may be positioned within the chamber, and responsive to the chamber being exposed to a flow of fluid, the tracer may interact with the fluid, leave the chamber, and return to a surface of the wellbore.

In other embodiments, the tracer material may be segments of portion of a tool, which may be affixed to a downhole tool mechanically. Responsive to flowing fluid around, through, etc. the tracer material, the tracer may return to the surface of the wellbore.

In other embodiments, the tracer material may be chemically coated, wrapped, molded, etc. over a surface of the downhole tools that interact with flowing fluid. Responsive to the flowing fluid interacting with the coating including the tracer materials, the tracers may return to a surface of the wellbore along with the fluid.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
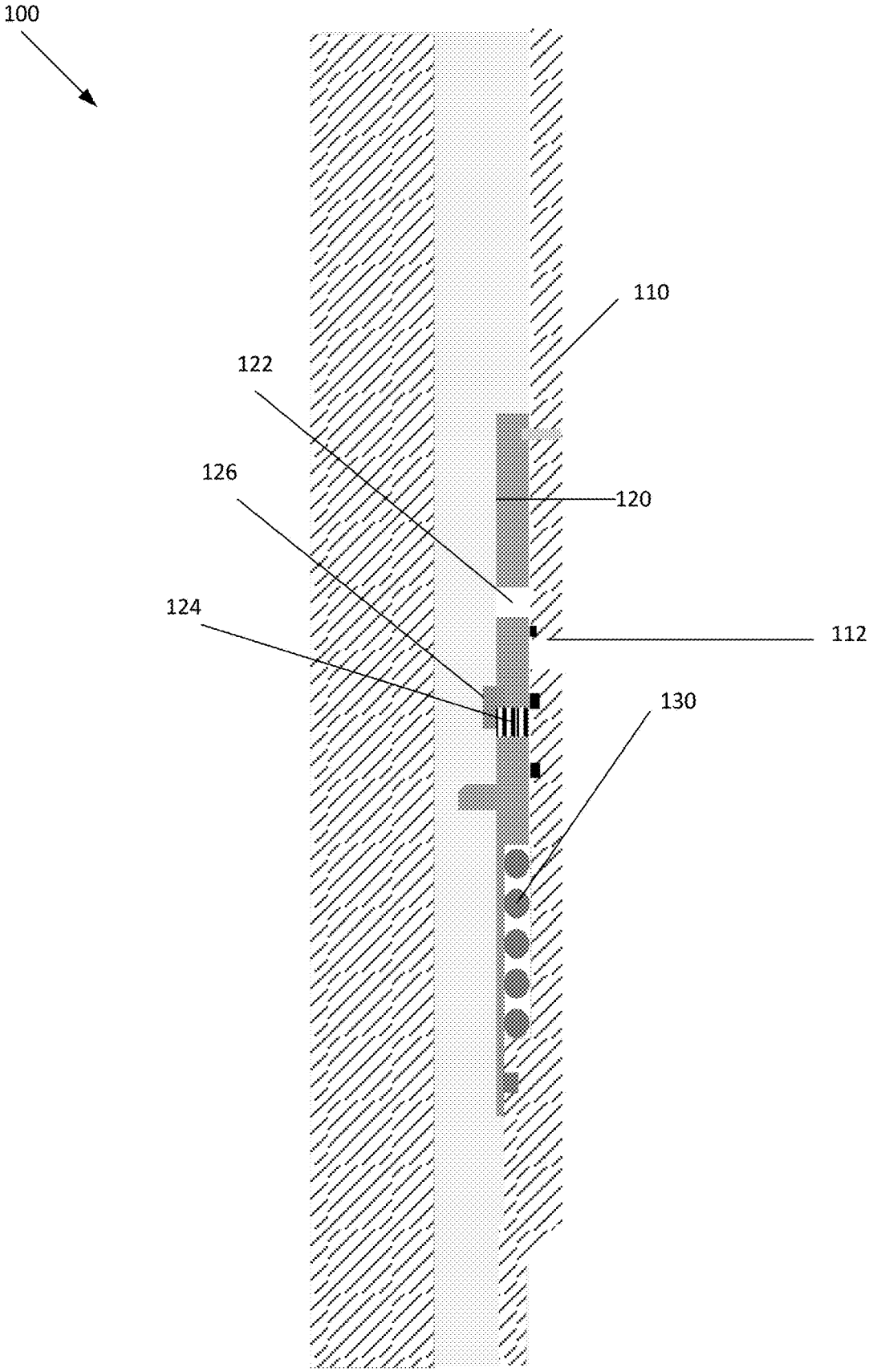
FIG. 1-5 depict systems and methods associated with a downhole tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Turning now to FIG. 1, FIG. 1 depicts a downhole tool 100, according to an embodiment. Downhole tool 100 may be configured to utilize tracer material embedded or mixed within dissolvable materials. The dissolvable materials with the embedded tracers may then be positioned within the inner or outer diameter of the tool 100. For example, tracer material may be a solute that is mixed with and dissolved in a solvent, wherein the solvent is a dissolvable material. This may allow the tracer material to be directly embedded and uniformly distributed within the dissolvable material. In embodiments, a wellbore may include a plurality of downhole tools 100, which may be aligned across their axis with one another. The plurality of downhole tools 100 may be aligned such that a first downhole tool 100 is positioned above a second downhole tool 100. This may enable a different downhole tool 100 to have tracer material with different markers being embedded within dissolvable material.

Tool 100 may include an outer sidewall 110, sliding sleeve 120, and force generating device 130. In embodiments, outer sidewall 110 and sliding sleeve 120 may be coupled together via shear screws or any other device that is configured to break responsive to an increase in pressure within tool 100. Responsive to the shear screws breaking, sliding sleeve 120 may move axially within tool 100.

Outer sidewall 110 may form a hollow chamber, channel, conduit, passageway, etc. across an inner diameter of outer sidewall 110. Positioned outside outer sidewall 110 may be an annulus between a geological formation and outer sidewall 110. The hollow chamber within outer sidewall 110 may extend form a top surface of outer sidewall 110 to a lower surface of outer sidewall 110. Outer sidewall 110 may have a port 112.

External port 112 may be a hole, passageway, etc. positioned through outer sidewall 110. External port 112 may be configured to allow communication between the hollow chamber within tool 100 to an annulus outside of tool 100.

Sliding sleeve 120 may be configured to be positioned within outer sidewall 110 and move in a first direction and a second direction based on a pressure within the hollow chamber and the force generated by force generating device 130. Sliding sleeve 120 may be configured to move in a first direction responsive to fluid flowing through the inner diameter of the tool creating a pressure against sliding sleeve 120 that is greater than the force applied to sliding sleeve 120 by force generating device 130 in a second direction. Sliding sleeve 120 may include a first port 122, second port 124, and dissolvable material 126.

First port 122 may be a hole, passageway, etc. positioned through sliding sleeve 120. First port 122 may be configured to be aligned with external port 112 to allow communication between the hollow chamber and annulus. First port 122 may be configured to be misaligned with external port 112 to disallow communication through port 112 to the annulus.

Second Port 124 may be a hole, passageway, etc. positioned through sliding sleeve 120. Second Port 124 may be configured to be aligned with external port 112 to allow communication between the hollow chamber and annulus. Second Port 124 may be configured to be misaligned with external port 112 to disallow communication through port 112 to the annulus. In embodiments, second port 124 may include a filter that is configured to limit the flow of larger elements through second port 124.

Dissolvable materials 126 may be configured to be positioned proximate to second port 124. Dissolvable materials 126 may have a solute tracer material that is dissolved into the solvent, such as the dissolvable, fragmentable, partitionable materials. This may enable the tracer material to be directly and uniformly embedded within dissolvable materials 126 before tool 100 is positioned down well. In embodiments, the dissolvable materials 126 with the embedded tracers may be configured to cover, partially cover, obstruct, etc. fluid flowing from the hollow inner chamber through second port 122 and external port 112. Responsive to the fluid interacting with dissolvable materials 126, the dissolvable materials with the embedded tracers may dissolve within the flowing fluid, and continue to flow along with the fluid. In embodiments, the tracer material embedded within the dissolvable materials 126 may include unique identifiers, such as a coloring, radioactive identifiers, DNA etc., which may be analyzed at a surface of the wellbore.

Force generating device 130 may be a device that is configured to apply an axial force against the sliding sleeve 120 in a second direction, wherein the second direction is an opposite direction than the first direction. Force generating device 130 may be a spring, hydraulic pump, mechanical membrane, etc. In embodiments, force generating device 130 may be configured to be compressed when run in hole, and when sliding sleeve 120 is coupled to outer sidewall via shear screws.

Figure 2:
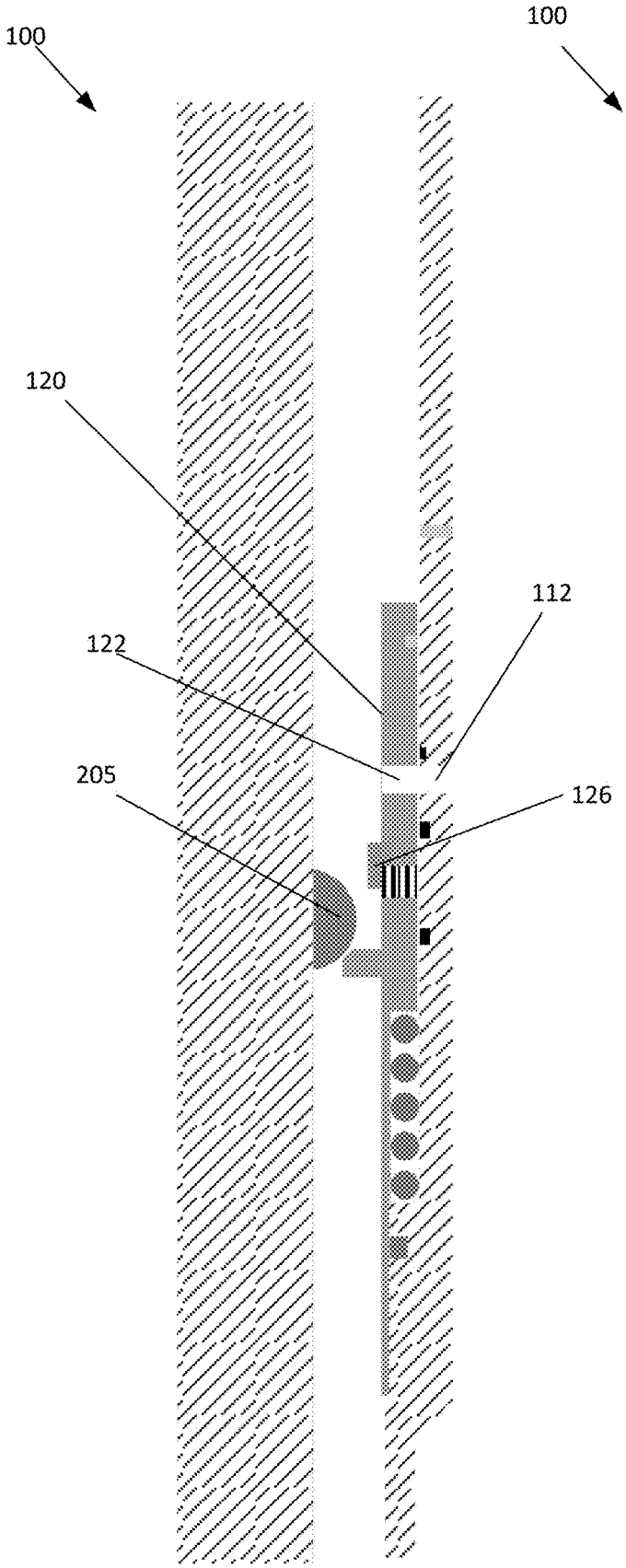

FIG. 2 depicts a downhole tool 100 responsive to positioning a ball 205 on a seat, according to an embodiment. Elements depicted in FIG. 2 may be described above, and for the sake of brevity a further description of these elements is omitted.

As depicted in FIG. 2, a ball 205 may be positioned within the hollow chamber, and form a temporary seal within the hollow chamber. As fluid flows through the inner chamber, the pressure above ball 205 may increase causing force generating device 130 to compress. This compression may slide sliding sleeve 120 downhole to align first port 122 and external port 112.

Figure 3:
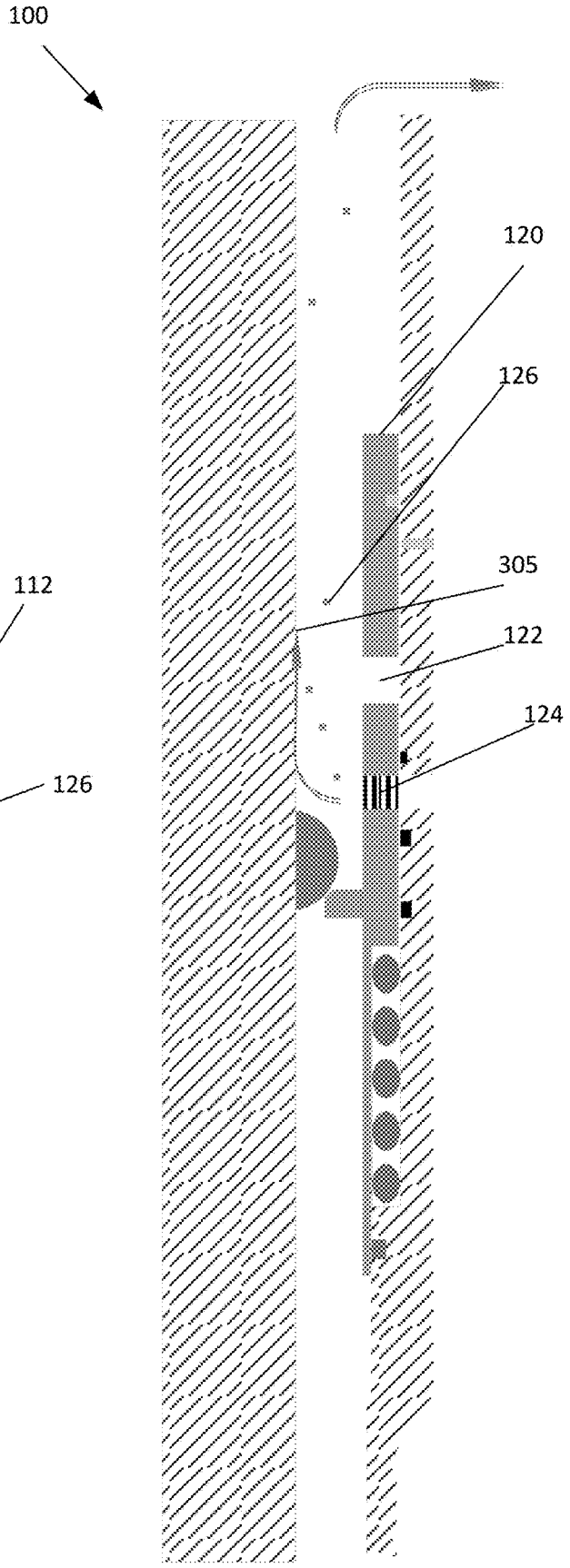

FIG. 3 depicts a downhole tool 100 responsive to positioning a ball 205 on a seat, according to an embodiment. Elements depicted in FIG. 3 may be described above, and for the sake of brevity a further description of these elements is omitted.

As depicted in FIG. 3, as fluid ceases to flow within the hollow chamber, force generating device 130 may elongate. This elongation may align second port 122 and external port 112. Due to fluid flowing through second port 122, dissolvable material 126 may interact with the flowing fluid 305 and dissolve. This may allow the dissolvable material 126 to return to the surface, wherein the embedded tracer material may also return to a surface level. In further embodiments, the inner diameter of tool 100 and/or sliding sleeve 120 may be coated 310 with a dissolvable material with an embedded tracer. Accordingly, responsive to flowing fluid through the inner diameter of the tool, the dissolvable material with the embedded tracer material may return to a surface.

Figure 5:
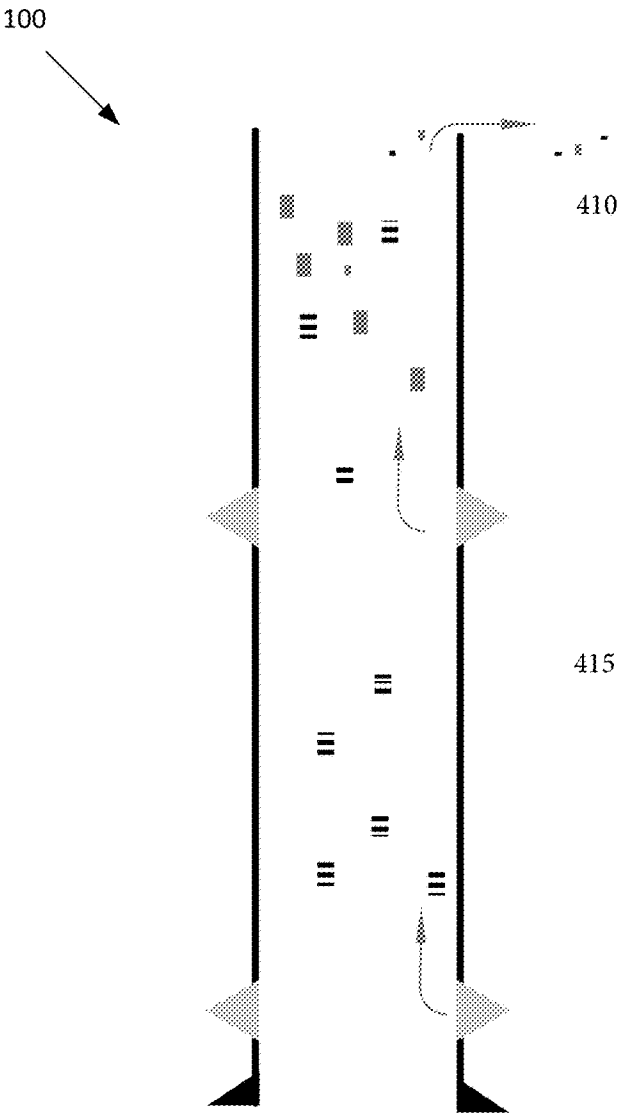
Figure 4:
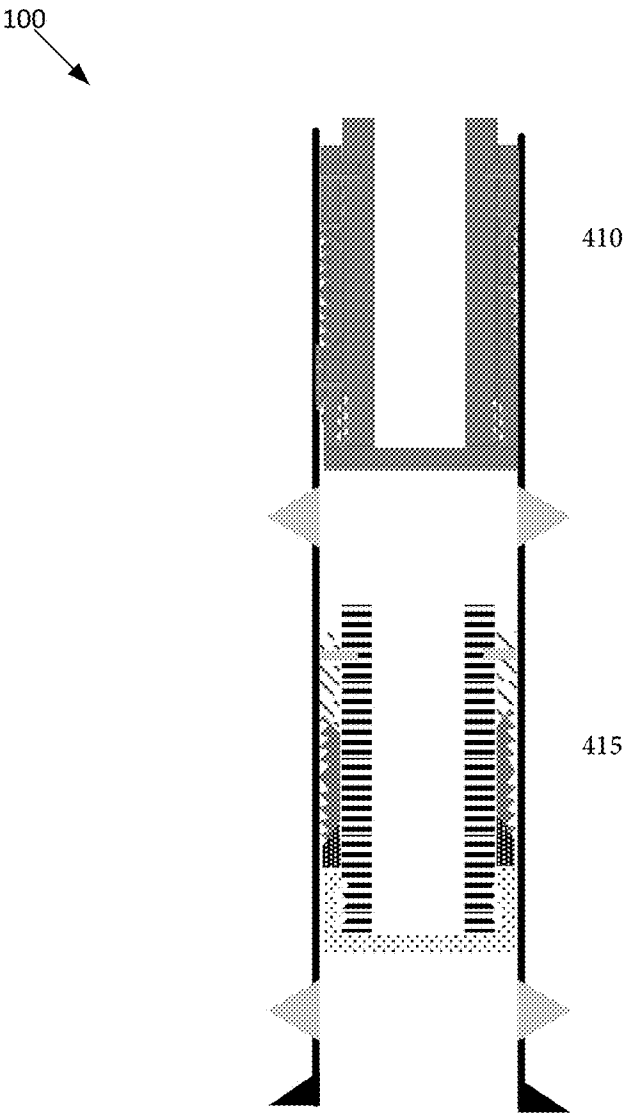

FIGS. 4 and 5 depict a downhole tool 100, according to an embodiment. As depicted in FIGS. 4 and 5 other elements positioned in a downhole tool may be comprised of materials that are embedded with a tracer material. For example, fragmentable, separable, or dissolvable materials, such as a temporary seal 410, 415 disclosed in U.S. 62/727,369 filed on Sep. 5, 2018, U.S. Pat. No. 10,400,521 filed on Feb. 4, 2019, and U.S. Ser. No. 16/423,367 filed on May 28, 2019, which are hereby incorporated by reference in its entirety, may have embedded tracers. The tracer material may be a solute that was dissolved within the temporary seal, which may be the solvent. Responsive to the temporary seal 410, 415 being fragmented due to fluid flowing through the inner diameter of the tool due to exposure to well fluid or temperature, portions of the temporary seal with the embedded surface may return to the surface.

However, one skilled in the art may appreciate that any material positioned within the hollow chamber may include embedded tracer materials, and/or materials coated with tracer materials.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A method for using a tracer system for a fracing operation comprising:

mixing a tracer with a dissolvable material before positioning a downhole tool within a wellbore;

mounting the tracer mixed with the dissolvable material on a movable sliding sleeve within the downhole tool, wherein the tracer mixed with the dissolvable material moves with the sliding sleeve to expose the dissolvable material, wherein the dissolvable material correspondingly moves when the movable sliding sleeve moves;

positioning the downhole tool with the tracer mixed with the dissolvable material downhole.

2. The method of claim 1, further comprising:

positioning the movable sliding sleeve within an inner diameter of the downhole tool, wherein the movable sliding sleeve includes a sleeve port extending through the sliding sleeve;

positioning the tracer mixed with the dissolvable material within a sleeve port of the movable sliding sleeve, the sleeve port extending from an inner diameter of the sleeve to an outer diameter of the movable sliding sleeve, wherein the dissolvable material mounted on the movable sliding sleeve is exposed responsive to the movable sliding sleeve moving.

3. The method of claim 2, further comprising:

covering an inner diameter of the sleeve port with the mixture of the dissolvable material and the tracer.

4. The method of claim 2, further comprising:

positioning the mixture of the dissolvable material and the tracer within a chamber, the chamber covering an inner diameter of the sleeve port.

5. The method of claim 2, further comprising:

exposing the tracer to fluid flowing within the wellbore responsive to the movable sliding sleeve moving.

6. The method of claim 2, further comprising:

aligning a casing port extending through the downhole tool and the sleeve port;

flowing fluid through the casing port and the sleeve port;

exposing the mixture of the dissolvable material and the tracer to a predetermined temperature for a predetermined amount of time;

dissolving the mixture of the dissolvable material and the tracer responsive to the flowing fluid through the casing port and the sleeve port due to exposure to predetermined temperature for a predetermined duration.

7. The method of claim 6, further comprising:

coating the mixture of the dissolvable material and the tracer of the downhole tool.

8. The method of claim 1, further comprising:

dissolving the tracer in the dissolvable material, wherein the dissolvable material acts as a solvent.

9. The method of claim 1, further comprising:

forming a temporary seal across an inner diameter of the downhole tool;

coating an upper surface of the temporary seal with the mixture of the dissolvable material and the tracer.

10. The method of claim 1, further comprising:

returning the tracer to a surface of the wellbore responsive to fluid within the wellbore interacting with the tracer and the dissolving material or responsive to exposure to predetermined temperature for a predetermined duration.

* * * * *